United States Patent [19]

Pitts

[11] Patent Number: 4,848,948

[45] Date of Patent: Jul. 18, 1989

[54] SIDE BINDER NOTEBOOK

[76] Inventor: Warren R. Pitts, 152 Greendale Ave., Needham, Mass. 02192

[21] Appl. No.: 246,489

[22] Filed: Sep. 19, 1988

[51] Int. Cl.[4] ..... B42F 3/04; B42F 13/16

[52] U.S. Cl. ..... 402/29; 281/33; 402/31; 402/79; 402/45; 402/70; 402/73

[58] Field of Search ..... 402/29, 31, 34, 45, 402/60, 68, 70, 71, 73, 78, 79, 80 R, 502; 281/33

[56] References Cited

U.S. PATENT DOCUMENTS

| | | | |
|---|---|---|---|
| 1,094,019 | 4/1914 | Reifel et al. | 402/80 R X |
| 1,723,030 | 8/1929 | Gerard | 402/70 |
| 4,244,660 | 1/1981 | Aronson | 402/79 |
| 4,573,821 | 3/1986 | Gilreath | 402/78 |
| 4,623,276 | 11/1986 | Kinneir | 402/80 R |

FOREIGN PATENT DOCUMENTS

| | | | |
|---|---|---|---|
| 0206911 | 12/1986 | European Pat. Off. | 402/80 R |
| 2353208 | 5/1975 | Fed. Rep. of Germany | 402/80 R |
| 2919907 | 11/1980 | Fed. Rep. of Germany | 402/73 |

*Primary Examiner*—Paul A. Bell

[57] ABSTRACT

Looseleaf notebooks, presentation devices and similar stationery items incorporating a binder mechanism attached to the side of the rear cover. Three slots are present along the side of the front cover positioned so as to fit into the ring binder mechanism to lock the notebook and secure all contents. The ring binder itself may contain a stiff paper or plastic insert for providing additional support for use as a presentation device. Such insert may includes three projections along the bottom manufactured to fit into the front cover slots to convert the notebook into an easel stand. The stiff insert additionally may function as the third side during vertical positioning of the notebook thereby allowing for a stable free standing presentation device.

9 Claims, 4 Drawing Sheets

SIDE BINDER NOTEBOOK

BACKGROUND OF THE INVENTION

This invention falls within the general category of stationery products and within the specific category of ring binder notebooks. As a class, binder notebooks have enjoyed wide marketability in both the business and educational sector as a useful device for storing papers. The traditional notebook incorporates a centrally located ring binder mechanism. This standard location of the binder mechanism, although widely used, presents some disadvantages.

The primary purpose of a binder mechanism is to secure papers. Yet a centrally placed binder mechanism imposes a limitation on the size of paper that may be stored. The size of paper which may be stored is limited to less than half the size of the notebook cover. To circumvent this restriction notebooks have been manufactured in many sizes to accomodate the need for a specific paper size. The production of notebooks in various sizes, however does not address the need for access to various sizes of paper within the same notebook. In particular professions and/or courses of academic study, a choice in size of paper within the same notebook is highly desireable. Notably this shortcoming has been acknowledged by the addition of interior cover pockets, yet their capacity is limited to a few sheets of paper and hence does not address the need entirely.

In addition, a centrally located ring binder mechanism does not lock the notebook itself but only the papers within the ring binder. While the rear and front covers do offer some protection, they only enclose the contents partially and do not secure the contents. An unlocked notebook is objectionable in that it contributes to the loss of unsecured papers during transportation and/or to paper damage and information loss when exposed to rain and snow.

Still another disadvantage of a centrally located binder mechanism, is its inherent two sidedness which mandates delicate balancing and/or use of extrinsic supports during vertical placement or easel stand positioning. The ability to place a notebook in a free-standing vertical or easel stand position is highly desireable as it enhances both presentation and individual general viewing.

Accordingly, it is a principal objective of the invention to provide improved designs for binder notebooks, presentation devices and like stationery items that alleviate the above noted disadvantages of the prior art. The invention seeks a design that secures and protects all contents, provides for storage of multi-sized papers and allows for free standing vertical and easel stand positioning.

SUMMARY OF THE INVENTION

To accomplish the aforementioned objectives, the invnetion provides a novel design for ring binder notebooks which is characterized by attaching the ring binder mechanism along the interior face of the rear cover. Complementary slots are provided in the front cover which may therefore be folded over to permit the rings to pass through the slots and secure the first cover.

In the preferred embodiment of the invention a plastic or metal ring binder mechanism is located along the interior face of the rear cover adjacent the outer edge thereof. Such placement advantageously allows for the insertion of any size paper up to 20 inches in width.

Another aspect of the invention is the use of a stiff insert as a support member to permit the notebook to be used as a presentation device. In the preferred embodiment, three projections are present along the bottom of the insert which fit into the front cover slots to facilitate the conversion of the notebook into a free standing easel stand. Alternatively, the insert functions as a stabilizing third side during free standing vertical placement such insert may be fabricated from paper or plastic material.

BRIEF DESCRIPTION OF THE DRAWINGS

The above and additional objectives of the invention are illustrated in their preferred embodiments in FIGS. 1-5.

DETAILED DESCRIPTION

Figure 1:
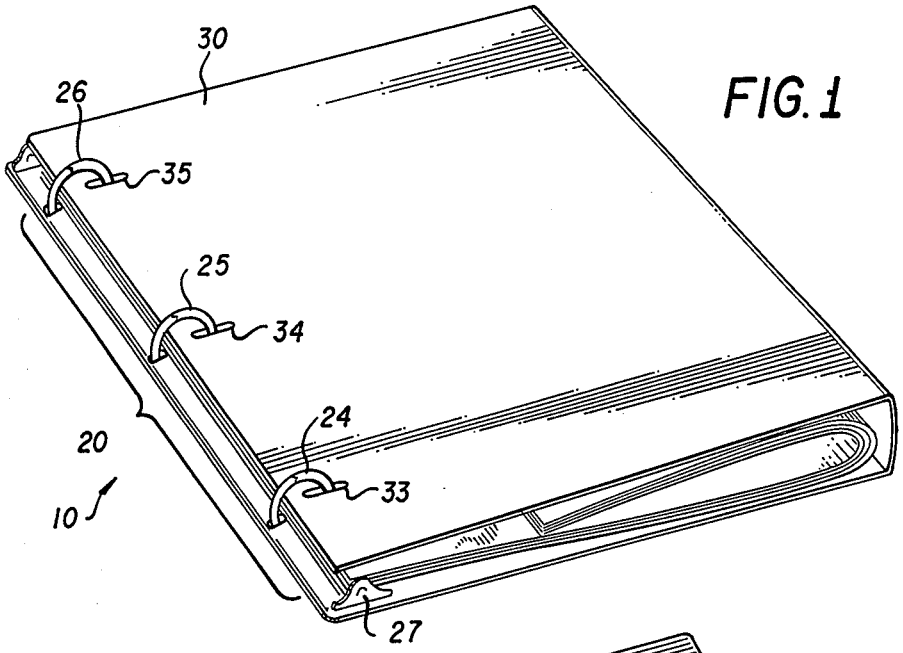
FIG. 1 offers a perspective view of a looseleaf notebook in a closed state and secured by a ring binder mechanism in accordance with the invention.

Reference should now be had to FIGS. 1–7 for a detailed description of the looseleaf notebook according to a preferred embodiment of the invention. FIG. 1 depicts a looseleaf notebook 10, closed and secured by a ring binder mechanism 20, attached to the interior face of the rear cover near the outer edge thereof. The notebook cover 30 may be fabricated from any suitable material such as plastic or paper material. Notebook cover 30 is folded along fold lines 38, 39 to provide front and rear covers 31 and 32, respectively, and an end portion 37. Front cover 31 contains three slots, 33, 34, and 35 punched or otherwise formed in its right outer edge. Slots 33, 34, and 35 are aligned with rings 24, 25, and 26 so as to permit the front cover to be folded over and secured by the rings.

Figure 6:
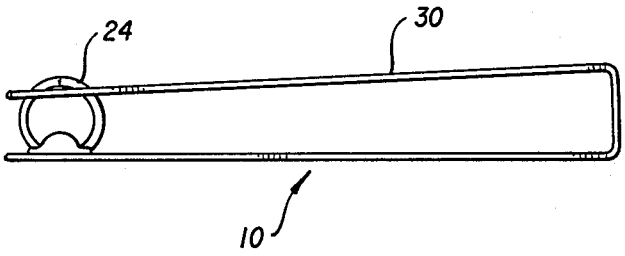
FIG. 6 is a side elevation view of the notebook of FIGS. 1 and 2, closed with the cover slots mating with but not secured by the binder rings.
Figure 7:
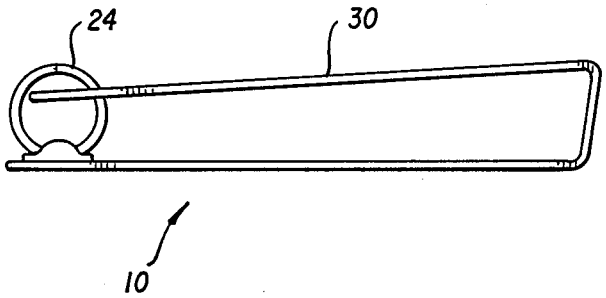
FIG. 7 is a side elevation view of the notebook of FIGS. 1 and 2, closed with the cover slots secured by the binder rings as in FIG. 1.

FIGS. 1 and 7 show in perspective and side views respectively the configuration wherein the top cover of the notebook has been folded over the opened binder rings 24–26 and the rings then closed through slots 33–35 respectively to secure the cover 30. Alternatively, as shown in FIG. 6, the cover may be closed so that the rings protrude through the slots but do not secure the cover.

The length of slots 33–35 may be closer so that when the front cover 31 is closed over rings 25–26, front and rear covers 31, 32 are maintained at a predesigned separation even with no or only a few sheets inserrted in the notebooks, by avoiding the awkward triangular configuration which normally occurs in a partially filled notebook.

The ring binder apparatus 20 incorporates a binder support 21, secured to the interior aspect of the rear cover, and three metal or plastic rings 24, 25, and 26, which embrace the binder support and are anchored to the interior surface of binder support 21 (by means not shown). Rings 24, 25 and 26 may be opened and closed by a simple manipulation of two levers 27 and 28, situated at either end of binder support 21. Ring binder mechanism 20 may be fabricated from metal or plastic material.

A variety of ring binder mechanisms of this design are well known in the art. Note that although the illustrated embodiment incorporates a stiff notebook cover 30 folded along two fold lines 38 and 39, other covers may be utilized such as pliable vinyl covers without discrete fold lines.

Figure 2:
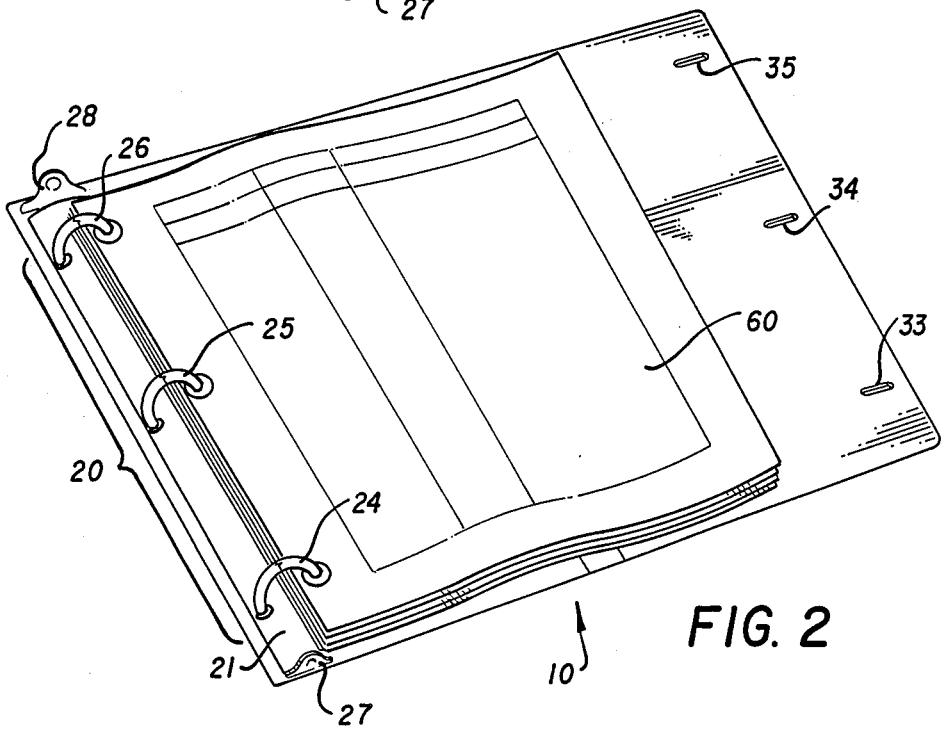
FIG. 2 depicts a perspective view of the looseleaf notebook of FIG. 1 in an open state, illustrating the notebooks storage of paper greater than ten inches in width.
Figure 4:
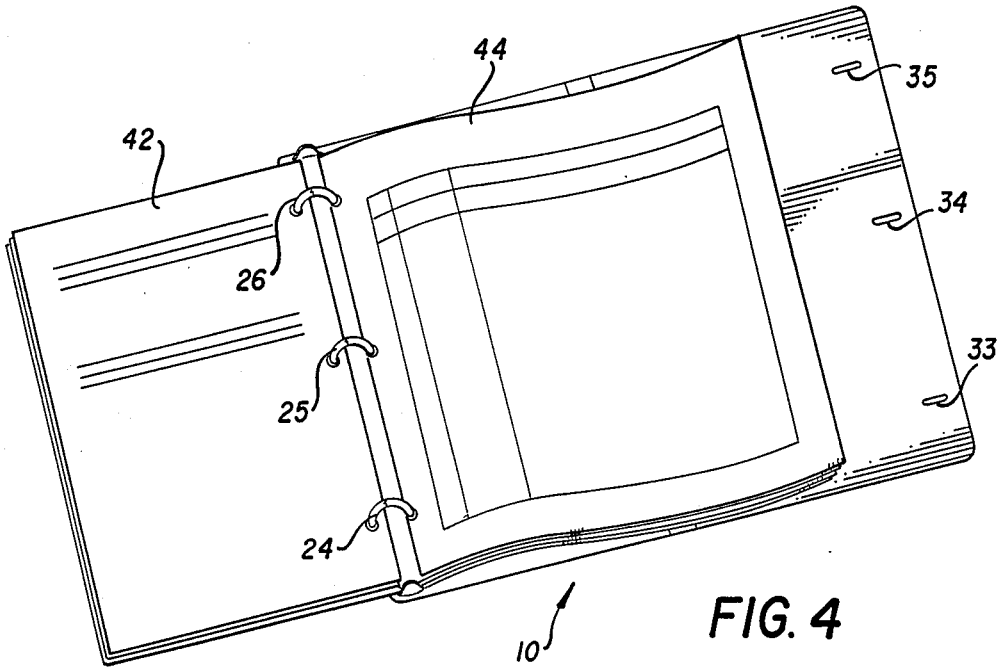
FIG. 4 offers a further perspective view of an opened looseleaf notebook illustrating its ability to hold paper in various sizes.

FIGS. 2 and 4 offer perspective views of an opened notebook 10, illustrating the notebook's ability to accomodate papers 60 of various widths. Papers 60 wider than 10 inches in width 40 (FIG. 2) are secured upon locking of notebook 10 by folding over upon therselves (see FIG. 1).

FIG. 4 shows, on the left, letter size ($8\frac{1}{2}$ inch by 11 inch) sheets 42 and on the right, 11 inch by 17 inch sheets 44.

Figure 3:
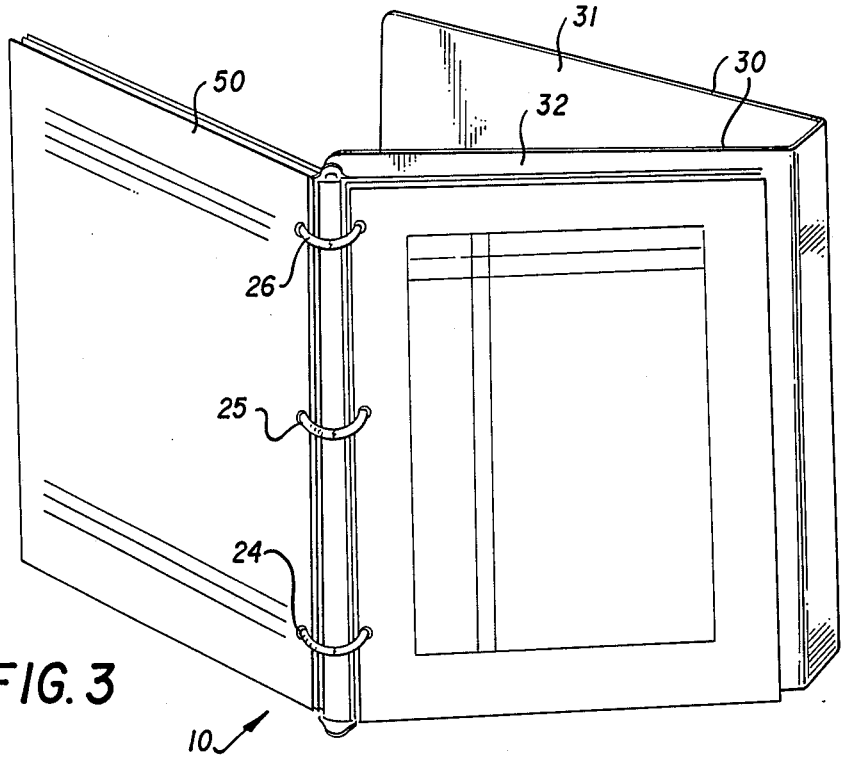
FIG. 3 offers a perspective view of an opened looseleaf notebook placed in a vertical position using a stiff insert member for support.

FIG. 3 illustrates notebook 10 in a free standing vertical position, using a stiff insert panel 50 retained by the ring binder 20 for support. Front cover 31 is inverted to assume a posterior position, rear cover 32 assumes the anterior position and the stiff insert 50 is placed at an angle to both covers so as to complete and stabilize the upright triangular formation.

Figure 5:
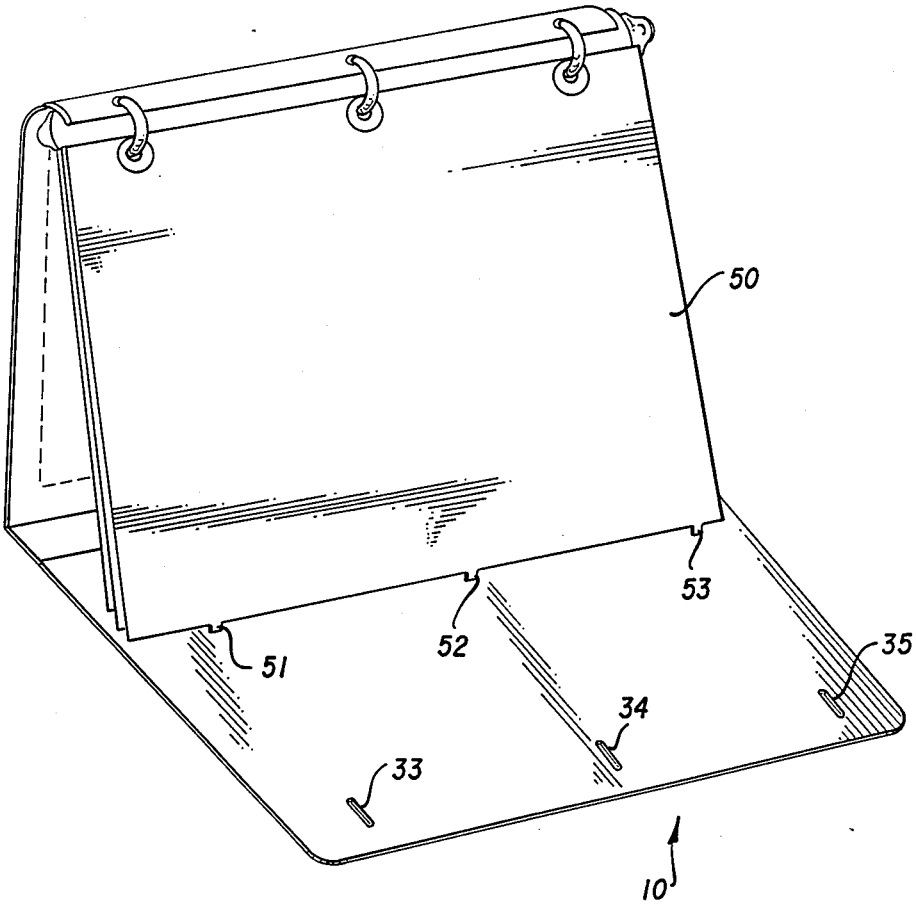
FIG. 5 offers a perspective view of a looseleaf notebook in an easel stand position, using a stiff insert member for support.

FIG. 5 depicts notebook 10 converted into an easel stand for presentation or the like. This triangular position is achieved by having front cover 31 comprise the base of the triangle and stiff insert panel 50 and rear cover 32, the sides. As in FIG. 3, stiff insert 50 is retained by ring binder 20. Present along the bottom of insert 50, are three complementary projections, 51, 52 and 53, which fit into the three cover slots 33, 34 and 35, and stabilize the easel stand. Insert 50 may be fabricated from any suitable material such as stiff paper or plastic materials. This embodiment additionally may incorporate a flip chart technique for presentation.

The drawings and description above are intended to be illustrative and not conclusive representations of the invention, thus allowing for changes that do not depart from the essence of the invention as set forth in the claims.

I claim:

1. A looseleaf binder for sheets of paper, comprising:

a continuous cover sheet including front and rear covers having inner and outer faces; and a ring binder mechanism secured to the inner face of the rear cover near the outer edge comprising a plurality of rings and means for opening and closing the rings, wherein the front cover includes a plurality of apertures complementing the rings of said ring binder mechanizm, wherein the front cover may be folded over the rear cover with the rings open, and the rings may then be closed to secure the covers together.

2. A looseleaf binder as defined in claim 1, wherein the front and rear covers are of an area to retain pages less than ten inches in width without folding, and significantly longer pages with folding.

3. A looseleaf binder as defined in claim 1, further comprising a stiff panel which may be inserted in and retained by said ring binder mechanism, to act as a support member for using said looseleaf binder as a presentation device.

4. A looseleaf binder as defined in claim 3, wherein the stiff panel is configured to serve as a stabilizing third side in a triangular vertical placement of said notebook.

5. The looseleaf binder of claim 3, wherein said panel is fabricated from paperboard or plastic.

6. A looseleaf binder as defined in claim 3, wherein the stiff panel has complementary projections fashioned to fit into the front cover slots to provide a free standing easel stand.

7. A looseleaf binder as defined in claim 1, wherein the apertures are slots parallel with the opening and closing axis of the rings.

8. A looseleaf notebook as defined in claim 1, wherein the apertures are slots of a length such that the front cover may be folded over the rear cover with the rings closed to provide a predetermined separation of the front and rear covers.

9. A looseleaf binder as defined in claim 1, wherein the front cover is folded over the rear cover at a pair of fold lines defining said front and rear covers and a spine.

* * * * *